United States Patent [19]

Faulring et al.

[11] 4,396,425

[45] Aug. 2, 1983

[54] ADDITION AGENT FOR ADDING VANADIUM TO IRON BASE ALLOYS

[75] Inventors: Gloria M. Faulring, Niagara Falls; Alan Fitzgibbon, Lewiston; Anthony F. Nasiadka, Lockport, all of N.Y.

[73] Assignee: Union Carbide Corporation, Danbury, Conn.

[21] Appl. No.: 249,503

[22] Filed: Mar. 31, 1981

[51] Int. Cl.[3] ..... C22C 33/08; C21C 7/00

[52] U.S. Cl. ..... 75/57; 75/129; 75/130 R

[58] Field of Search ..... 75/53, 129, 130 R, 24

[56] References Cited

U.S. PATENT DOCUMENTS

| | | | |
|---|---|---|---|
| 2,386,486 | 5/1958 | Brennan et al. | 75/27 |
| 2,935,397 | 5/1960 | Saunders et al. | 75/44 |
| 2,999,749 | 9/1961 | Saunders et al. | 75/58 |
| 3,579,328 | 5/1971 | Aas | 75/130 R |
| 4,071,355 | 1/1979 | Staggers | 75/129 |

FOREIGN PATENT DOCUMENTS 833098 4/1960 United Kingdom .

OTHER PUBLICATIONS

"Development of Exothermic Vanadium Oxide Addition Agents", Dec. 26, 1946.

"Electromelt" Bulletin EMC-65, (1957) and attached letter 3/26/57.

*Primary Examiner*—P. D. Rosenberg

*Attorney, Agent, or Firm*—John R. Doherty

[57] ABSTRACT

Addition of vanadium to molten iron-base alloys using an agglomerated mixture of $V_2O_3$ and calcium-bearing reducing agent.

12 Claims, 4 Drawing Figures

Electron Image

Ca Distribution

Al Distribution

ADDITION AGENT FOR ADDING VANADIUM TO IRON BASE ALLOYS

Figure 1:
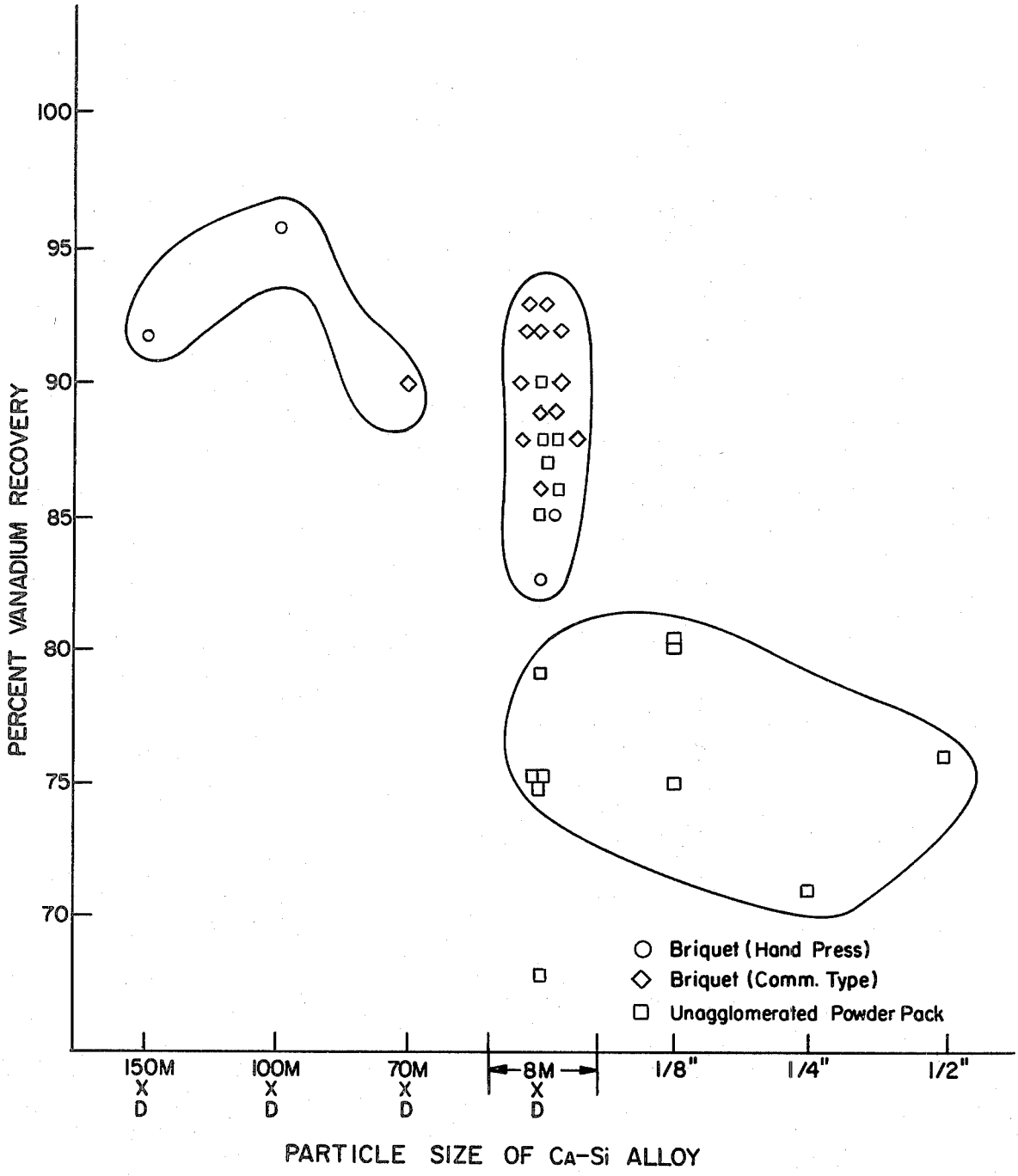

The present invention is related to the addition of vanadium to molten iron-base alloys, e.g., steel. More particularly, the present invention is directed to an addition agent comprising $V_2O_3$ and a calcium-bearing reducing agent.

It is a common requirement in the manufacture of iron base alloys, e.g., steel, to make additions of vanadium to the molten alloy.

Previous commercial techniques have involved the use of ferrovanadium alloys and vanadium and carbon, and vanadium, carbon and nitrogen containing materials as disclosed in U.S. Pat. No. 3,040,814.

Such materials, while highly effective in many respects, require processing techniques that result in aluminium, carbon and nitrogen containing additions and consequently, cannot be satisfactorily employed in all applications, e.g., the manufacture of pipe steels and quality forging grades of steel.

Pelletized mixtures of $V_2O_5$ plus aluminum; $V_2O_5$ plus silicon plus calcium-silicon alloy; $V_2O_5$ plus aluminum plus calcium-silicon, and "red-cake" plus 21%, 34% or 50% calcium-silicon alloy have been previously examined as a source of vanadium in steel by placing such materials on the surface of molten steel. The "red-cake" used was a hydrated sodium vanadate containing 85% $V_2O_5$, 9% $Na_2O$ and 2.5% $H_2O$. The results were inconclusive, probably due to oxidation and surface slag interference.

It is therefore an object of the present invention to provide a vanadium addition for iron base alloys, especially a vanadium addition that does not require energy in preparation and which enables, if desired, the efficient addition of the vanadium metal constituent without adding carbon or nitrogen.

Figure 2A:
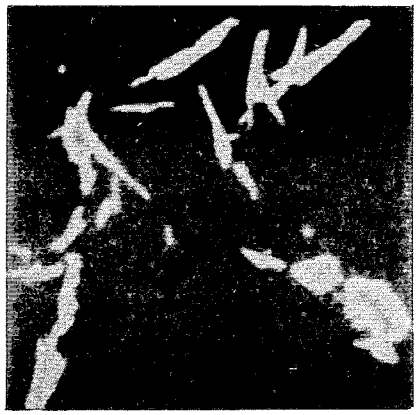
Figure 2B:
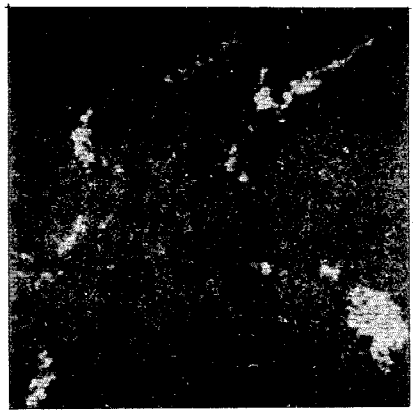
Figure 2C:
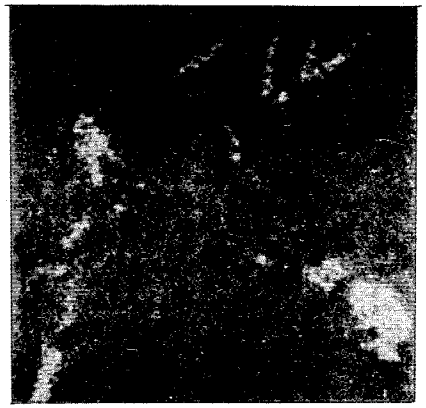

Other objects will be apparent from the following descriptions and claims taken in conjunction with the drawing wherein:

FIG. 1 is a graph showing the effect of particle sizing on vanadium recovery and FIGS. 2 (*a*)–(*c*), show electron probe analyses of steel treated in accordance with the present invention.

The vanadium addition agent of the present invention is a blended, agglomerated mixture consisting essentially of $V_2O_3$ (at least 95% by weight $V_2O_3$) and a calcium-bearing reducing agent. The mixture contains about 55 to 65% by weight of $V_2O_3$ and 35% to 45% by weight of calcium-bearing reducing agent. In a preferred embodiment of the present invention, the reducing agent is a calcium-silicon alloy, about 28–32% by weight Ca and 60–65% by weight Si, containing primarily the phases $CaSi_2$ and Si; the alloy may advantageously contain up to about 8% by weight iron, aluminum, barium, and other impurities incidental to the manufacturing process, i.e., the manufacture of calcium-silicon alloy by the electric furnace reduction of CaO and $SiO_2$ with carbon. (Typical analyses: Ca 28–32%, Si 60–65%, Fe 5.0%, Al 1.25%, Ba 1.0%, and small amounts of impurity elements.)

In the practice of the present invention a blended, agglomerated mixture of $V_2O_3$ and calcium-silicon alloy is prepared in substantially the following proportions: 50% to 70%, preferably 55% to 65% by weight $V_2O_3$ and 30% to 50%, preferably 35% to 45% by weight calcium-silicon alloy. The particle size of the calcium-silicon alloy is predominantly (more than 90%) 8 mesh and finer (8M×D) and the $V_2O_3$ is sized predominantly (more than 90%) 100 mesh and finer (100M×D).

The mixture is thoroughly blended and thereafter agglomerated, e.g., by conventional compacting techniques so that the particles of the $V_2O_3$ and reducing agent such as calcium-silicon alloy particles are closely associated in intimate contact. The closely associated agglomerated mixture is added to molten steel where the heat of the metal bath and the reducing power of the reducing agent are sufficient to activate the reduction of the $V_2O_3$. The metallic vanadium generated is immediately integrated into the molten metal.

It is important that the addition agent of the present invention be rapidly immersed in the molten metal to minimize any reaction with oxygen in the high temperature atmosphere above the molten metal which would oxidize the calcium-bearing reducing agent. Also, contact of the addition agent with any slag or slag-like materials on the surface of the molten metal should be avoided so that the reactivity of the addition is not diminished by coating or reaction with the slag. This may be accomplished by several methods. For example, by plunging the addition agent, encapsulated in a container, into the molten metal or by adding compacted mixture into the pouring stream during the transfer of the molten metal from the furnace to the ladle. In order to ensure rapid immersion of the addition agent into the molten metal, the ladle should be partially filled to a level of about one-quarter to one-third full before starting the addition, and the addition should be completed before the ladle is filled. The CaO and $SiO_2$ formed when the vanadium oxide is reduced enters the slag except when the steel is aluminum deoxidized. In that case, the CaO generated modifies the $Al_2O_3$ inclusions resulting from the aluminum deoxidation practice.

$V_2O_3$ (33% O) is the preferred vanadium oxide source of vanadium because of its low oxygen content. Less calcium-bearing reducing agent is required for the reduction reaction on this account and, also a small amount of CaO and $SiO_2$ is generated upon addition to molten metal.

In addition, the melting temperature of the $V_2O_3$ (1970° C.) is high and thus, the $V_2O_3$ plus calcium-silicon alloy reduction reaction temperature closely approximates the temperature of molten steel (>1500° C.). Chemical and physical properties of $V_2O_3$ and $V_2O_5$ are tabulated in Table VI.

The following example further illustrates the present invention.

EXAMPLE

Procedure

Armco iron was melted in a magnesia-lined induction furnace with argon flowing through a graphite cover. After the temperature was stabilized at 1600° C.±10° C., the heat was blocked with silicon. Next, except for the vanadium addition, the compositions of the heats were adjusted to the required grade. After stabilizing the temperature at 1600° C.±5° C. for one minute, a pintube sample was taken for analyses and then a vanadium addition was made by plunging a steel foil envelope containing the vanadium addition into the molten steel. The steel temperature was maintained at 1600° C.±5° C. with the power on the furnace for three minutes after addition of the $V_2O_3$ plus reducing agent mixture. Next, the power was shut off and after one minute, pintube samples were taken and the steel cast into a 100-pound, 10.2 $cm^2$ ($4''^2$) ingot. Subsequently, specimens removed from mid-radius the ingot, one-third up from the bottom, were examined microscopically and analyzed chemically. Some were analyzed on the electron microprobe.

Various mixtures of $V_2O_3$ plus reducing agent were added as a source of vanadium in molten steel having different compositions. In Table I, the results are arranged in order of increasing vanadium recoveries for each of the steel compositions. The data in Table II compares the vanadium recoveries for various grades of steel when the vanadium additions were $V_2O_3$ plus calcium-silicon alloy (8M×D) mixtures compacted under different conditions representing different pressures, and in Table III, when the particle size of the calcium-silicon alloy was the principal variable. In order to more completely characterize the preferred $V_2O_3$ plus calcium-silicon alloy addition mixture, the particle size distribution of the commercial grade calcium-silicon alloy (8M×D) is presented in Table IV. It may be noted that 67% is less than 12 mesh and 45% less than 20 mesh. As shown in FIG. 1, finer particle size fractions of the calcium-silicon alloy are efficient in reducing the $V_2O_3$, however, the 8M×D fraction is not only a more economical but also a less hazardous product to produce than the finer fractions.

In some grades of steel, the addition of carbon or carbon and nitrogen is either acceptable or beneficial. Vanadium as well as carbon or carbon plus nitrogen can also be added to these steels by reducing the $V_2O_3$ with $CaC_2$ or $CaCN_2$ as shown in Table V.

As noted above Table I represents the experimental heats arranged in order of increasing vanadium recoveries for each steel composition. It may be noted that reducing agents such as aluminum and aluminum with various fluxes, will reduce $V_2O_3$ in molten steel. However, for all of these mixtures, the vanadium recoveries in the steels were less than 30 percent.

As shown in Table I and FIG. 1, optimum vanadium recoveries were recorded when the vanadium source was a closely associated mixture of 60% $V_2O_3$ (100M×D) plus 40% calcium-silicon alloy (8M×D). It may also be noted in Table I that the vanadium recoveries are independent of the steel compositions. This is particularly evident in Table II where the vanadium recovery from the 60% $V_2O_3$ plus 40% calcium-silicon alloy, 8M×D, mixtures exceeded 80% in aluminum-killed steels (0.08–0.22% C), semi-killed steels (0.18–0.30%), and plain carbon steels (0.10–0.40% C). Moreover, Table II shows that the vanadium recovery gradually improved when the 60% $V_2O_3$ plus 30% calcium-silicon alloy (8M×D) was briquetted by a commercial-type process using a binder instead of being packed by hand in the steel foil immersion envelopes. In other words, the close association of the $V_2O_3$ plus calcium-silicon alloy mixture that characterizes commercial-type briquetting with a binder improves vanadium recoveries. For example, the heats with the addition methods emphasized by squarelike enclosures in Table II were made as duplicate heats except for the preparation of the addition mixture. In all but one pair of heats, the vanadium recoveries from the commercial-type briquets were superior to tightly packing the mixture in the steel foil envelopes.

The data in Table III show the effect of the particle size of the reducing agent, calcium-silicon alloy, in optimizing the vanadium recoveries. Again, the vanadium recoveries were independent of the steel compositions and maximized when the particle size of the calcium-silicon alloy was 8M×D or less as illustrated in the graph of FIG. 1. Although high vanadium recoveries >90%, were measured when the particle size ranges of the calcium-silicon alloy were 150M×D and 100M×D, the potential hazards and costs related to the production of these size ranges limit their commercial applications. For this reason, 8M×D calcium-silicon alloy has optimum properties for the present invention. The particle size distribution of commercial grade 8M×D is shown in Table IV.

When small increases in the carbon or carbon-plus-nitrogen contents of the steel are either acceptable or advantageous for the steelmaker, $CaC_2$ and/or $CaCN_2$ can be employed as the reducing agent instead of the calcium-silicon alloy. It has been found that commercial grade $CaC_2$ and $CaCN_2$ are also effective in reducing $V_2O_3$ and adding not only vanadium but also carbon or carbon and nitrogen to the molten steel. The results listed in Table V show the vanadium recoveries and increases in carbon and nitrogen contents of the molten steel after the addition of $V_2O_3$ plus $CaC_2$ and $V_2O_3$ plus $CaCN_2$ mixtures.

Specimens removed from the ingots were analyzed chemically and also examined optically. Frequently, the inclusions in the polished sections were analyzed on the electron microprobe. During this examination, it was determined that the CaO generated by the reduction reaction modifies the alumina inclusions characteristic of aluminum-deoxidized steels. For example, as shown in the electron probe illustrations of FIG. 2 where the contained calcium and aluminum co-occur in the inclusions. Thus, the addition of the $V_2O_3$ plus calcium-bearing reducing agent to molten steel in accordance with present invention is not only a source of vanadium but also the calcium oxide generated modifies the detrimental effects of alumina inclusions in aluminum-deoxidized steels. The degree of modification depends on the relative amounts of the CaO and $Al_2O_3$ in the molten steel.

In view of the foregoing it can be seen that a closely associated agglomerated mixture of $V_2O_3$ and calcium-bearing reducing agent is an effective, energy efficient source of vanadium when immersed in molten steel.

The mesh sizes referred herein are U.S. Screen series.

TABLE I

Vanadium Additives for Steel

| Type Steel | Heat No. | V Source(1) % $V_2O_3$ | Reducing Agent(2) Identity | % Wt. | Particle Size | V Addition Method(3) | % V Added | % V Recovered Furnace-"3-Min." | % C |
|---|---|---|---|---|---|---|---|---|---|
| Low Carbon: | | | | | | | | | |
| 0.036–0.05% Al<br>0.10–0.12% C<br>0.16–0.31% Si | J635 | 65 | Al<br>+3%<br>Flux | 32<br>40% Cryolite<br>+60% $CaF_2$(oil) | Powder | P | 0.25 | 4 | |

TABLE I-continued

Vanadium Additives for Steel

| Type Steel | Heat No. | V Source(1) % $V_2O_3$ | Reducing Agent(2) Identity | % Wt. | Particle Size | V Addition Method(3) | % V Added | % V Recovered Furnace-"3-Min." | % C |
|---|---|---|---|---|---|---|---|---|---|
| 1.50-1.60% Mn | J636 | 67 | $CaF_2$(Flux) | 3 | | | | | |
| | | | Al | 30 | Powder | P | 0.25 | 10 | |
| | J639 | 65 | Al | 35 | 7-100M (Granules) | P | 0.25 | 36 | |
| | J637 | 65 | Al | 35 | Shot | P | 0.25 | 52 | |
| | J647 | 60 | "Hypercal" | 40 | ⅛" | P | 0.25 | 64 | |
| | J645 | 60 | CaSi | 40 | ¼" | P | 0.25 | 72 | |
| | J676 | 60 | CaSi | 40 | ½" | P | 0.25 | 76 | |
| | J644 | 60 | CaSi | 40 | ⅛" | P | 0.25 | 80 | |
| | J641 | 60 | CaSi | 40 | ⅛" | P | 0.25 | 80 | |
| | J619 | 65 | CaSi | 35 | 8M × D | P | 0.13 | 80 | |
| | J615 | 50 | CaSi | 50 | 8M × D | P | 0.13 | 85 | |
| | J614 | 55 | CaSi | 45 | 8M × D | P | 0.13 | 87 | |
| | J620 | 60 | CaSi | 40 | 8M × D | P | 0.13 | 88 | |
| | J798 | 60 | CaSi | 40 | 150M × D | B | 0.25 | 92 | |
| | J800 | 60 | CaSi | 40 | 8M × D | BC | 0.25 | 92 | |
| | J799 | 60 | CaSi | 40 | 100M × D | B | 0.25 | 96 | |
| Carbon Steels: | | | | | | | | | |
| 0.03-0.07% Al | J645 | 60 | CaSi | 40 | ⅛" | P | 0.20 | 75 | |
| 0.23-0.29% C | J672 | 65 | $CaC_2$ | 35 | ¼" × 1/12" | P | 0.20 | 76 | |
| 0.27-0.33% Si | J671 | 55 | $CaC_2$ | 45 | ¼" × 1/12" | P | 0.20 | 77 | |
| 1.35-1.60% Mn | J669 | 65 | CaSi | 35 | 8M × D | P | 0.20 | 79 | |
| | J670 | 70 | CaSi | 30 | 8M × D | P | 0.20 | 81 | |
| | J657 | 60 | $CaC_2$ | 40 | 1/12" × ¼" | P | 0.20 | 83 | |
| | J656 | 60 | CaSi | 40 | 8M × D | P | 0.20 | 87 | |
| | J655 | 60 | CaSi | 40 | 8M × D | P | 0.20 | 90 | |
| Carbon Steels: | | | | | | | | | |
| 0.04-0.07% Al | J678* | 60 | $CaCN_2$ | 40 | <325M | P | 0.20 | 50 | |
| 0.15-0.20% C | J677* | 65 | $CaCN_2$ | 35 | <325M | P | 0.20 | 55 | |
| 0.22-0.28% Si | J679* | 55 | $CaCN_2$ | 45 | <325M | P | 0.20 | 60 | |
| 1.40-1.50% Mn | J680* | 50 | $CaCN_2$ | 50 | <325M | P | 0.20 | 60 | |
| | J674 | 65 | CaSi | 35 | 8M × D | B | 0.20 | 80 | |
| | J675 | 60 | $CaC_2$ | 40 | 16M × D | P | 0.20 | 85 | |
| | J676 | 65 | $CaC_2$ | 35 | 16M × D | P | 0.20 | 85 | |
| | J673 | 60 | CaSi | 40 | 8M × D | B | 0.20 | 85 | |
| Carbon Steels: | | | | | | | | | |
| 0.03-0.07% Al | J634 | 60 | CaSi | 40 | 8M × D | P | 0.25 | 68* | 0.08 |
| 0.27-0.33% Si | J699 | 60 | CaSi | 40 | 8M × D | Loose | 0.20 | 81 | 0.17 |
| 1.35-1.60% Mn | J673 | 60 | CaSi | 40 | 8M × D | B | 0.20 | 85 | 0.13 |
| | J714 | 60 | CaSi | 40 | 8M × D | P | 0.20 | 86 | 0.16 |
| | J734 | 60 | CaSi | 40 | 8M × D | BC | 0.19 | 89 | 0.08 |
| | J747 | 60 | CaSi | 40 | 8M × D | BC | 0.21 | 90 | 0.10 |
| Semi-Killed: | | | | | | | | | |
| 0.07-0.12% Si | J709 | 60 | CaSi | 40 | 8M × D | P | 0.149 | 75 | 0.30 |
| 0.62-0.71% Mn | J708 | 60 | CaSi | 40 | 8M × D | P | 0.15 | 75 | 0.21 |
| | J707 | 60 | CaSi | 40 | 8M × D | P | 0.16 | 79 | 0.16 |
| | J702 | 60 | CaSi | 40 | 8M × D | BC | 0.15 | 89 | 0.38 |
| | J735 | 60 | CaSi | 40 | 70M × D | BC | 0.20 | 90 | 0.08 |
| | J700 | 60 | CaSi | 40 | 8M × D | BC | 0.16 | 93 | 0.18 |
| | J701 | 60 | CaSi | 40 | 8M × D | BC | 0.16 | 93 | 0.25 |
| Plain Carbon: | | | | | | | | | |
| 0.19-0.29% Si | J710 | 60 | CaSi | 40 | 8M × D | P | 0.15 | 75 | 0.10 |
| 0.54-0.85% Mn | J711 | 60 | CaSi | 40 | 8M × D | P | 0.17 | 85 | 0.20 |
| | J713 | 60 | CaSi | 40 | 8M × D | BC | 0.17 | 86 | 0.38 |
| | J706 | 60 | CaSi | 40 | 8M × D | BC | 0.15 | 88 | 0.40 |
| | J705 | 60 | CaSi | 40 | 8M × D | BC | 0.15 | 88 | 0.31 |
| | J703 | 60 | CaSi | 40 | 8M × D | BC | 0.15 | 90 | 0.11 |
| | J712 | 60 | CaSi | 40 | 8M × D | P | 0.18 | 92 | 0.29 |
| | J704 | 60 | CaSi | 40 | 8M × D | BC | 0.16 | 92 | 0.18 |

*Presumed erratic result (1)Vanadium Source: $V_2O_3$ - >99% pure, 100M × D (commercial product, UCC).

(2)Reducing Agents: CaSi Alloy - 29.5% Ca, 62.5% Si, 4.5% Fe, trace amounts of Mn, Ba, Al, C, etc. (commercial product, UCC).
$CaCN_2$ - >99% pure, 325M × D (chemical reagent).
$CaC_2$ - Foundry grade, 66.5% $CaC_2$ (commercial product, UCC) - (¼" × 1/12" particle size).
Al Powder - Alcoa Grade No. 12-1978.
"Hypercal" - 10.5% Ca, 39% Si, 10.3% Ba, 20% Al, 18% Fe.

(3)B: Briquetted in hand press-no binder.
P: Tightly packed in steel foil envelope.
Loose: Placed in immersion capsule-not packed.
BC: Briquetted by commercial-type practice with binder.
} All additions made by plunging the vanadium addition mixtures into the molten steel in low-carbon steel foil envelopes.

*About 10 pounds of metal thrown from the furnace when the $V_2O_3$ + $CaCN_2$ was plunged.

TABLE II

Effect of Packing Density and Steel Compositions on Vanadium Recoveries

Vanadium Source: 60% $Y_2O_3$ + 40% CaSi (8M × D)

| Heat No. | % V Added | Addition Method* | Composition of Furnace - "3 Minute" Pintube (Steel) % C | % Si | % Al | % Mn | % V | % V Recovery | |
|---|---|---|---|---|---|---|---|---|---|
| **J634 | 0.25 | P | 0.077 | 0.24 | 0.057 | 1.49 | 0.16 | 68 | Al-Killed increasing C content |
| J620 | 0.13 | P | 0.085 | 0.30 | 0.059 | 1.51 | 0.114 | 88 | |
| J673 | 0.20 | B | 0.130 | 0.23 | 0.074 | 1.51 | 0.17 | 85 | |
| J714 | 0.20 | P | 0.16 | 0.275 | 0.061 | 1.514 | 0.172 | 86 | |
| J699 | 0.20 | No P | 0.17 | 0.284 | 0.063 | 1.609 | 0.161 | 81 | |
| J655 | 0.20 | P | 0.21 | 0.29 | 0.055 | 1.64 | 0.180 | 90 | |
| J656 | 0.20 | P | 0.22 | 0.32 | 0.05 | 1.69 | 0.17 | 87 | |
| | | | | | No Al Added | | | | |
| J734 | 0.186 | BC | 0.08 | 0.16 | | 0.50 | 0.165 | 89 | Semi-Killed increasing C content |
| J747 | 0.2052 | BC | 0.10 | 0.39 | | 0.82 | 0.19 | 93 | |
| J700 | 0.172 | BC | 0.18 | 0.069 | | 0.657 | 0.16 | 93 | |
| J707 | 0.20 | P | 0.16 | 0.107 | | 0.704 | 0.158 | 79 | |
| J701 | 0.172 | BC | 0.25 | 0.069 | | 0.64 | 0.16 | 93 | |
| J708 | 0.20 | P | 0.21 | 0.106 | | 0.704 | 0.15 | 75 | |
| J702 | 0.172 | BC | 0.38 | 0.097 | | 0.708 | 0.153 | 89 | |
| J709 | 0.20 | P | 0.30 | 0.121 | | 0.626 | 0.149 | 75 | |
| J703 | 0.172 | BC | 0.11 | 0.21 | | 0.543 | 0.154 | 90 | Plain C increasing C content |
| J710 | 0.20 | P | 0.10 | 0.245 | | 0.573 | 0.15 | 75 | |
| J704 | 0.172 | BC | 0.18 | 0.195 | | 0.543 | 0.159 | 92 | |
| J711 | 0.20 | P | 0.20 | 0.287 | | 0.616 | 0.17 | 85 | |
| J705 | 0.172 | BC | 0.31 | 0.233 | | 0.873 | 0.152 | 88 | |
| J712 | 0.20 | P | 0.29 | 0.253 | | 0.861 | 0.183 | 92 | |
| J706 | 0.172 | BC | 0.40 | 0.224 | | 0.831 | 0.152 | 88 | |
| J713 | 0.20 | P | 0.38 | 0.252 | | 0.845 | 0.172 | 86 | |

*The vanadium additions were made by plunging steel foil envelopes containing the 60% $V_2O_3$ + 40% calcium-silicon mixtures into molten steel (1660° C. ± 5° C.). The mixtures were placed in the envelopes as [1] tightly packed mix (P); [2] not packed (no P); [3] briquets made in a hand press, no binder (B); or [4] commercial-type briquets made on a briquetting machine with a binder (BC).

**presumed erratic result

TABLE III

Influence of Calcium-Silicon Alloy Particle Size on the Recovery of Vanadium from Vanadium Oxide in Steel

| | | V Source Heat No. | % $V_2O_3$ | CaSI % | Particle Size | Addition Method* | % V Added | % V Recovered |
|---|---|---|---|---|---|---|---|---|
| Low Carbon: | 0.036–0.05% Al, 0.10–0.12% C, | J798 | 60 | 40 | 150M × D | B | 0.25 | 92 |
| | 0.16–0.31% Si, 1.50–1.60% Mn | J799 | 60 | 40 | 100M × D | B | 0.25 | 96 |
| | | J800 | 60 | 40 | 8M × D | C | 0.25 | 92 |
| | | J645 | 60 | 40 | ¼" | P | 0.25 | 72 |
| | | J646 | 60 | 40 | ½" | P | 0.25 | 76 |
| | | J644 | 60 | 40 | ⅛" | P | 0.25 | 80 |
| | | J641 | 60 | 40 | ⅛" | P | 0.25 | 80 |
| | | J640 | 60 | 40 | 8M × D | P | 0.13 | 88 |
| Carbon Steels: | 0.04–0.07% Al, 0.23–0.29% C, | J654 | 60 | 40 | ⅛" | P | 0.20 | 75 |
| | 0.27–0.33% Si, 1.35–1.60% Mn | J656 | 60 | 40 | 8M × D | P | 0.20 | 87 |
| | | J655 | 60 | 40 | 8M × D | P | 0.20 | 90 |
| Semi-Killed: | 0.19–0.40% Si, | J735 | 60 | 40 | 70M × D | BC | 0.195 | 90 |
| | 0.60–0.80% Mn, 0.08–0.10% C | J747 | 60 | 40 | 70M × D | BC | 0.205 | 93 |

*P: Tightly packed in steel foil envelope.
B: Briquets made by hand in a press and packed in steel foil envelope.
BC: Commercial-type briquets made in a briquetting machine and packed in steel foil envelope.
} Added by plunging into molten steel at 1600° C. ± 5° C.

TABLE IV

Particle Size Distribution of Calcium-Silicon Alloy (8 Mesh × Down)

6 Mesh - Maximum
4% on 8M
33% on 12M
55% on 20M

TABLE IV-continued

Particle Size Distribution of Calcium-Silicon Alloy (8 Mesh × Down)

68% on 32M
78% on 48M
85% on 65M
89% on 100M

TABLE IV-continued

| Particle Size Distribution of Calcium-Silicon Alloy (8 Mesh × Down) |
|---|
| 93% on 150M |
| 95% on 200M |

Products of Union Carbide Corporation, Metals Division

TABLE V

Vanadium Additives for Steel Containing Carbon or Carbon Plus Nitrogen

| Carbon Steel: | Heat No. | % $V_2O_3$(1) | Reducing Agent(2) Identity | % | Particle Size | V Addition Method(3) | % V Added | % V Recovered Furnace | % C Inc.(4) | N (ppm) Inc.(4) |
|---|---|---|---|---|---|---|---|---|---|---|
| 0.03–0.7% Al | J672 | 65 | $CaC_2$ | 35 | ¼" × ½" | P | 0.20 | 76 | 0.02 | |
| 0.23–0.29% C | J671 | 55 | $CaC_2$ | 45 | ¼" × ½" | P | 0.20 | 77 | 0.03 | |
| 0.27–0.33% Si | J657 | 60 | $CaC_2$ | 40 | ½" × ¼" | P | 0.20 | 83 | 0.03 | |
| 1.35–1.60% Mn | | | | | | | | | | |
| 0.04–0.07% Al | J678* | 60 | $CaCn_2$ | 40 | <200M | P | 0.20 | 50 | 0.02 | 120 |
| 1.15–0.20% C | J677* | 65 | $CaCn_2$ | 35 | <200M | P | 0.20 | 55 | 0.01 | 102 |
| 0.22–0.28% Si | J679* | 55 | $CaCn_2$ | 45 | <200M | P | 0.20 | 60 | 0.03 | 194 |
| 1.40–1.50% Mn | J680* | 50 | $CaCN_2$ | 50 | <200M | P | 0.20 | 60 | 0.03 | 225 |
| | J675 | 60 | $CaC_2$ | 40 | 16M × D | P | 0.20 | 85 | 0.04 | |
| | J676 | 65 | $CaC_2$ | 35 | 16M × D | P | 0.20 | 85 | 0.04 | |

(1)$V_2O_3$: >99% pure, 100M × D (commercial product, UCC).
(2)$CaC_2$: 80% $CaC_2$, 14% CaO, 2.9% $SiO_2$, 1.6% $Al_2O_3$ (commercial product, UCC).
$CaCn_2$: 50% Ca, 15% C, 35% N (chemically pure).
(3)Mixture tightly packed in steel foil envelope and plunged into molten steel - 1600° C. ± 5° C.
(4)Increase in % C and ppm N in molten steel due to addition of vanadium plus $CaC_2$ or $CaCN_2$ mixture ("3-minute" pintube samples).
*About 10 pounds of metal thrown out of furnace due to violence of the reaction.

TABLE VI

Comparison of Properties of $V_2O_5$

| Property | $V_2O_3$ | $V_2O_5$ | Reference |
|---|---|---|---|
| Density | 4.87 | 3.36 | 1 |
| Melting Point Point | 1970° C. | 690° C. | 1 |
| Color | Black | Yellow | 1 |
| Character of Oxide | Basic | Amphoteric | 2 |
| Composition | 68% V + 32% 0 | 56% V + 44% 0 | (Calc.) |
| Free Energy of Formation (1900° K.) | −184,500 cal/mole | −202,000 cal/mole | 3 |
| Crystal Structure | $a_o$ = 5.45 ± 3 A<br>α = 54°49′ ± 8′<br>Rnombohedral | $a_o$ = 4.369 ± 5 A<br>$b_o$ = 11.510 ± 8 A<br>$c_o$ = 3.563 ± 3 A<br>Orthohrombic | 4 |

What is claimed is:

1. An addition agent for adding vanadium to molten iron base alloys consisting essentially of an agglomerated, blended mixture of about 50 to 70% by weight of finely divided $V_2O_3$ with about 30 to 50% by weight of a finely divided calcium-bearing material selected from the group consisting of calcium-silicon alloy, calcium carbide and calcium cyanamide.

2. An addition agent in accordance with claim 1 wherein said $V_2O_3$ is sized predominantly 100 mesh and finer and said calcium-bearing material is sized predominantly 8 mesh and finer.

3. An addition agent in accordance with claim 1 wherein said calcium-bearing material is calcium-silicon alloy.

4. An addition agent in accordance with claim 1 wherein said calcium-bearing material is calcium carbide.

5. An addition agent in accordance with claim 1 wherein said calcium-bearing material is calcium-cyanamide.

6. A method for adding vanadium to molten iron-base alloy which comprises immersing in molten iron-base alloy an addition agent consisting essentially of an agglomerated, blended mixture of about 50 to 70% by weight of finely divided $V_2O_3$ with about 30 to 50% by weight of a finely divided calcium-bearing material selected from the group consisting of calcium-silicon alloy, calcium carbide and calcium cyanamide.

7. A method in accordance with claim 6 wherein said $V_2O_3$ is sized predominantly 100 mesh and finer and said calcium-bearing material is sized predominantly 8 mesh and finer.

8. A method in accordance with claim 6 wherein said calcium-bearing material is calcium-silicon alloy.

9. A method in accordance with claim 6 wherein said calcium-bearing material is calcium carbide.

10. A method in accordance with claim 6 wherein said calcium-bearing material is calcium-cyanamide.

11. A method for adding vanadium to molten iron-base alloy which comprises preparing an addition agent consisting essentially of an agglomerated, blended mixture of about 50 to 70% by weight of finely divided $V_2O_3$ with about 30 to 50% by weight of a finely divided calcium-bearing material selected from the group consisting of calcium-silicon alloy, calcium carbide and calcium cyanamide, and then rapidly immersing the addition agent into the molten iron-base alloy so as to avoid any significant exposure of the addition agent to oxidizing conditions.

12. A method in accordance with claim 11 wherein the addition agent is immersed into the molten iron-base alloy in a manner such as to avoid substantial contact with any slag-like materials present on the surface of the molten metal.

* * * * *

UNITED STATES PATENT AND TRADEMARK OFFICE

CERTIFICATE OF CORRECTION

PATENT NO. : 4,396,425

DATED : August 2, 1983

INVENTOR(S) : Gloria M. Faulring, Alan Fitzgibbon and Anthony F. Nasiadka

It is certified that error appears in the above—identified patent and that said Letters Patent is hereby corrected as shown below:

Col. 3, line 52 - "30%" should be "40%".

Table I - Col. 5 - First item under "Carbon Steels" should be "J654" not J645.

Table VI - Col. 9 - The third item under "Property", the word "Point", is not needed.

Signed and Sealed this

*Fifteenth* Day of *November 1983*

[SEAL]

*Attest:*

GERALD J. MOSSINGHOFF

*Attesting Officer*

*Commissioner of Patents and Trademarks*